US006531855B2

(12) United States Patent
Miki et al.

(10) Patent No.: US 6,531,855 B2
(45) Date of Patent: Mar. 11, 2003

(54) DC POWER SUPPLY WITH OUTPUT VOLTAGE DETECTION AND CONTROL

(75) Inventors: Takeshi Miki, Okazaki (JP); Junichi Nagata, Okazaki (JP); Hiroyuki Ban, Aichi-ken (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/892,534

(22) Filed: Jun. 28, 2001

(65) Prior Publication Data

US 2002/0030472 A1 Mar. 14, 2002

(30) Foreign Application Priority Data

Jun. 30, 2000 (JP) ..... 2000-198760

(51) Int. Cl.[7] ..... G05F 1/40
(52) U.S. Cl. ..... 323/285; 323/901; 363/49
(58) Field of Search ..... 323/282, 284, 323/285, 901, 908; 363/49

(56) References Cited

U.S. PATENT DOCUMENTS 5,625,279 A * 4/1997 Rice et al. ..... 323/283
6,204,646 B1 * 3/2001 Hiramatsu et al. ..... 323/273

FOREIGN PATENT DOCUMENTS

| | | |
|---|---|---|
| JP | A-58-169605 | 10/1983 |
| JP | A-59-133439 | 7/1984 |
| JP | A-4-37914 | 2/1992 |

* cited by examiner

*Primary Examiner*—Michael Sherry
*Assistant Examiner*—Gary L. Laxton
(74) *Attorney, Agent, or Firm*—Law Offices of David G. Posz

(57) ABSTRACT

A series circuit including a capacitor and a resistor for detecting variation of the output voltage of dc power supply is further provided. During startup, a charge current corresponding to the rising rate of the output voltage flows through the series circuit. This reduces the base current of the power transistor to suppress the rising rate to suppress overshoot and undershoot. A clamp circuit is provided to the differential amplifier for detecting the error voltage. This prevents the saturation in the differential amplifier or limit the voltage variation amplitude to accelerate the operation of the operational amplifier and suppress undershoot. A delay circuit for disabling to driving circuit for the power transistor for the initial interval may be further provided to suppress the initial rapid rise of the output voltage.

29 Claims, 7 Drawing Sheets

DC POWER SUPPLY WITH OUTPUT VOLTAGE DETECTION AND CONTROL

BACKGROUND OF THE INVENTION

1. Field of the Invention

This invention relates to a dc power supply for supplying a dc power supply.

2. Description of the Prior Art

A dc power supply for supplying a dc regulated voltage from an input dc voltage with voltage control is known. FIG. 6 is a schematic circuit diagram of a prior art series regulator type of a dc power supply. In FIG. 6, a PNP type of transistor T1 is connected between an input terminal 2 and an output terminal 3 of the dc power supply 1, wherein an emitter is connected to the input terminal 1 and the collector is connected to the output terminal 3. Moreover, a smoothing capacitor C1 is connected between the output terminal 3 and a ground terminal 4. The transistor T1 is controlled by a power supply control IC 5. For example, in a dc power supply mounted on an automotive vehicle, an input voltage Vb is supplied through an ignition switch from a battery (these are not shown).

The power supply control IC 5 comprises a voltage divider 6, an operational amplifier 7, a driving circuit 8, a constant voltage supply circuit 9, and a constant current supply circuit 10. The voltage divider 6 detects the output voltage Vo through a voltage dividing structure. The detected output voltage Vd and a reference voltage Vr are supplied to the base of a transistor T2 and to the base of the transistor T3 forming a differential pair 11 in the operational amplifier 7, respectively.

The driving circuit 8 comprises transistors T4 and T5 connected to each other with a Darlington connection. Their collectors are connected to the base of the transistor T1. The transistors T4 and T5 operate in response to the error amplified voltage Ve from an output node n1 of the operational amplifier 7. Moreover, the capacitor C2 is provided for phase compensation connected between the output terminal 3 and the emitter of the transistor T5.

When the ignition switch is turned on and thus, the input voltage Vb (for example 14 V) rises stepwise, the constant voltage supply circuit 9 and the constant current supply circuit 10 immediately start their operations to output a predetermined constant voltage and a constant current. In response to this, the operational amplifier 7 and the drive circuit 8 starts their operations.

FIGS. 7A to 7C are graphical drawings showing output voltage variations on startup of the dc power supply according to the prior art, wherein the capacitor C1 is varied. FIG. 7A shows the output variation with the capacitor C1 of 6.8 $\mu$F, FIG. 7B, 33 $\mu$F, and FIG. 7C, 220 $\mu$F. The dividing ratio of the voltage divider is 5:1, the reference voltage Vr is 1 V, the target voltage of the output voltage Vo is 5 V, and the output terminal 3 is connected to a resistive load of 12Ω.

At the startup of the power supply, that is, start of supplying the input voltage Vb, the output voltage Vo (the detection output voltage Vd) is 0 V. On the other hand, the reference voltage Vr is constant (1V). Then, the base voltage of the transistor T2 at the differential pair 11 of the operational amplifier 7 is lower than the base voltage of the transistor T3, so that the amplified error voltage Ve at the output node n1 increases. As a result, the base current to the transistor T1 flows through the transistor T5 of the driving circuit 8. This turns off the transistor T1, and thus, the output voltage Vo rapidly increases.

In this operation, if the output voltage Vo rapidly increases, the variation in the amplified error voltage Ve outputted from the operational amplifier 7 is delayed because the operational amplifier 7 cannot trace the variation of the output voltage Vo. As a result, the operational amplifier 7 cannot suppress the base current of the transistor T1 after the output voltage Vo reaches the target voltage, so that overshoot of the output voltage Vo occurs.

After this, the amplified error voltage Ve changes to descent from the ascent. In response to this change, the transistor T5 of the driving circuit 8 begins to decrease the base current of the transistor T1, so that the output voltage Vo begins to decrease. After the output voltage Vo decreases to the target of the output voltage Vo, the base current cannot be increased immediately due to the delay in the operational amplifier. As a result, under shoot is developed at the output voltage Vo.

Accordingly, the output voltage Vo converges to the target voltage with repetition of overshoot and under shoot at the startup of the power supply. In this operation, there is the tendency that the lower the capacity of the capacitor C1 the greater overshoot and the greater undershoot.

SUMMARY OF THE INVENTION

The aim of the present invention is to provide a superior dc power supply.

According to the present invention, a first aspect of the present invention provides a dc power supply comprising: a transistor for converting an input voltage into an output voltage on the basis of a driving condition; an error amplifier for generating an error signal on the basis of a difference voltage between a reference voltage and said output voltage; and a driving circuit for driving said power transistor on the basis of said error signal, directly detecting said output voltage, and controlling said driving condition to control a rise of said output voltage on at least a startup of said dc power supply.

According to the present invention, a second aspect of the present invention provides a dc power supply based on the first aspect, wherein said driving circuit suppresses a rate of said rise until said amplified error signal becomes in a steady condition after said startup.

According to the present invention, a third aspect of the present invention provides a dc power supply based on the first aspect, wherein said driving circuit suppresses a rate of said rise such that said amplified error signal can trace said output voltage.

According to the present invention, a fourth aspect of the present invention provides a dc power supply based on the first aspect, wherein said driving circuit includes: a voltage detection circuit for detecting a variation of said output voltage; and a driving control circuit for controlling said driving condition of said transistor on the basis of said variation detected by said voltage detection circuit.

According to the present invention, a fifth aspect of the present invention provides a dc power supply based on the fourth aspect, wherein said driving control circuit comprises a current mirror circuit for outputting a current determining said driving condition of said transistor in response to a current corresponding to said error signal, and said voltage detection circuit comprises a capacitor and a resistor connected in series, connected between said output voltage and a common control input of said current mirror circuit. In this case, the resistor in the voltage detection circuit can be omitted. That is, the voltage detection circuit may include only a capacitor.

According to the present invention, a sixth aspect of the present invention provides a dc power supply based on the fifth aspect, further comprising a delay circuit for keeping said transistor in an OFF condition for a predetermined delay interval after start of supplying said input voltage to said dc power supply.

According to the present invention, a seventh aspect of the present invention provides a dc power supply based on the sixth aspect, wherein said driving circuit further comprises a switch circuit for cutting off an output current of said current mirror circuit, and said delay circuit comprise an input voltage detection circuit for detecting start of supplying of said input voltage and a delay control circuit for controlling said switch circuit in said cutoff condition for said delay time from said start of supplying of said input voltage.

According to the present invention, an eighth aspect of the present invention provides a dc power supply based on the first aspect, wherein said error amplifier comprises a clamp circuit for accelerating a response of said error amplifier.

According to the present invention, a ninth aspect of the present invention provides a dc power supply based on the eighth aspect, wherein said error amplifier comprises a differential amplifier and said clamp circuit includes at least a diode connected to an output of said differential amplifier.

According to the present invention, a tenth aspect of the present invention provides a dc power supply comprising: a transistor for converting an input voltage into an output voltage on the basis of a driving signal; an error voltage detection circuit including an amplifier for generating an amplified error signal in accordance with a difference between a reference voltage and said output voltage with a predetermined delay to control said output voltage toward a target voltage; a driving circuit for generating said drive signal on the basis of said amplified error signal; and a surge control circuit for directly detecting said output voltage with substantially no delay and controlling said driving circuit to control rise of said output voltage on a startup of said dc power supply on he basis of said detected output voltage change.

According to the present invention, an eleventh aspect of the resent invention provides a dc power supply based on the tenth aspect, wherein said surge control circuit suppresses a rate of said rise until said output voltage reaches said target voltage on said startup.

According to the present invention, a twelfth aspect of the present invention provides a dc power supply based on the tenth aspect, wherein said amplifier amplifies said difference within a controllable range in a steady condition of said dc power supply, and said surge control circuit suppresses a rate of said rise such that said amplifier amplifies said difference within said controllable range on said startup.

According to the present invention, a thirteenth aspect of the present invention provides a dc power supply based on the tenth aspect, wherein said surge control circuit detects a variation of said output voltage.

According to the present invention, a fourteenth aspect of the present invention provides a dc power supply based on the tenth aspect, further comprises a delay circuit for keeping said transistor in an OFF condition for a predetermined delay interval after start of supplying said input voltage to said dc power supply.

According to the present invention, a fifteenth aspect of the present invention provides a dc power supply based on the tenth aspect, wherein said amplifier comprises a signal transistor for amplifying said error signal and a clamp circuit for clamping an output of said signal transistor to accelerate a response of said amplifier.

According to the present invention, a sixteenth aspect of the present invention provides a dc power supply based on the tenth aspect, wherein said detection circuit including resistive means and a capacitor, and said control circuit include a resistance to said capacitor as said resistive means.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

FIRST EMBODIMENT

Figure 1:
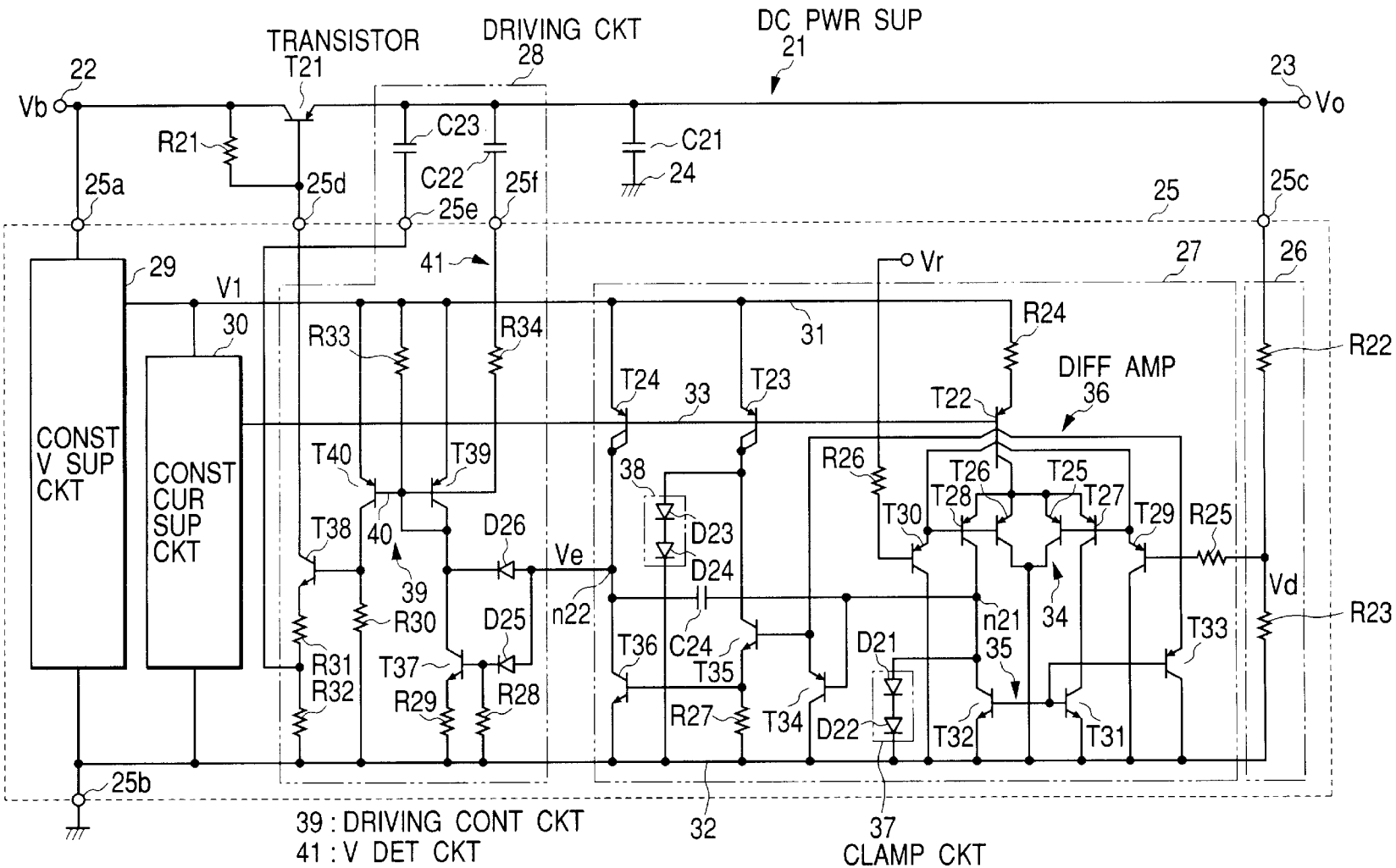
FIG. 1 is a schematic circuit diagram of a dc power supply according to a first embodiment.

FIG. 1 is a schematic circuit diagram of a series type of a dc power supply 21 according to a first embodiment.

The dc power supply 21 is used in an engine control electronic control unit (engine control ECU) for an automobile vehicle for example. The input terminal 22 of the dc power supply 21 is supplied with a battery voltage Vb as an input voltage (for example, 14 V) from a positive terminal of a battery (not shown) through an ignition switch (not shown). The output terminal 23 of the dc power supply 21 is connected to the engine control ECU as a load to supply the output voltage Vo (for example 5 V) thereto.

The dc power supply 21 is of a series type, and thus, a PNP transistor T21 is connected between the input 22 and the output 23. More specifically, the emitter of the transistor T21 is connected to the input terminal 22 and the collector of the transistor T21 is connected to the output terminal 23. A resistor R21 is connected between the base and the emitter of the transistor T21. A smoothing capacitor C21 is connected between the output terminal 23 and a ground terminal 24. Moreover, one end of a capacitor C22 for detecting a variation of the output voltage Vo and one end of a phase compensation capacitor C23 are connected to the output terminal 23.

The transistor T21 is controlled by a power supply control IC 25. The transistor T21, the resistor R21, the capacitors C21, C22, and C23 are fixed outside the power supply control IC 25. The power supply control IC 25 includes a voltage divider 26, an operational amplifier 27 (corresponding to an error amplifier), a driving circuit 28, a constant voltage supply circuit 29, and a constant current supply circuit 30.

The constant voltage supply circuit 29 is connected to the input terminal 22 through a terminal 215*a* and to the ground terminal 24 through a terminal 25*b* and generates a constant regulated voltage V1 (for example, 5 V) from the battery voltage Vb. The regulated voltage V1 is supplied to other circuits through the regulated voltage line 31 and the ground line 32.

The constant current supply circuit 30 has a circuit structure for generating a constant collector current at the collector of an output transistor (not shown) thereof. The collector of this transistor is connected to bases of transistors T22, T23, and T24 (mentioned later) at the operational amplifier 27 through a common base line 33.

The terminal 25*c* of the power supply control IC 25 is connected to the output terminal 23 of the dc power supply 21. The voltage divider 26 includes a resistor R22 and R23 connected in series between this terminal 25*c* and the ground line 32. The junction point voltage between the resistors R22 and R23 is used as a detected output voltage Vd. Dividing the output voltage Vo by a ratio (for example, 5:1) provides this voltage.

The operational amplifier 27 includes multi-collector type of PNP transistors T22, T23, T24 of which bases are connected to the common base line 33. Out of them, emitters of the transistors T23 and T24 are directly connected to the regulated voltage line 31. On the other hand, the emitter of the transistor T22 is connected to the regulated voltage line 31 through a resistor R24. This structure allows predetermined currents to flow through collectors of respective transistors T22, T23, and T24,.

Between the collectors of the transistor T22 and the ground line 32, a differential pair 34 including PNP transistors T25, T27, and T29, and PNP transistors T26, T28, T30, a current mirror circuit 35 including NPN transistors T31 and T32, and PNP transistors T33 and T34 are connected. The resistor R24, the transistor T22, the differential pair 34, and the current mirror circuit 35 form a differential amplifier 36.

In the differential amplifier 36, the current mirror circuit 35 as an active load is connected between the collectors of the transistors T27 and T28 and the ground line 32. The base of the transistor T27 is supplied with the detected output voltage Vd through the transistor T29 and the resistor R25. The base of the transistor T28 is supplied with a referential voltage Vr through the transistor T30 and a resistor R26. This circuit structure is provided to reduce the input current to the differential amplifier 36 to decrease the offset voltage of the differential amplifier 36.

Collectors of the transistor T27, T25, T26, and T28 are connected to the ground line 32, wherein the emitter and base of transistor T27 are connected to emitter and base of T25, respectively, and the emitter and base of transistor T26 are connected to emitter and base of T28, respectively. This structure divides the collector current of the transistor T22, so that the magnitude of a current flowing through the current mirror circuit 35 can be adjusted.

The junction point between the collector of the transistor T28 and the collector of the transistor T32 acts as an output node n21 of the differential amplifier 36. Between the output node n21 and the ground line 32, a clamp circuit 37 including diodes D21 and D22 connected in series is connected, wherein the cathode of the diode D22 is connected to the ground line 32 and the anode of the diode D22 is connected to the cathode of the diode D21.

Between the collector of the transistor T23 and the ground line 32, a series circuit including an NPN transistor T35 and a resistor R27 is connected. Moreover, in parallel to this series circuit, a clamp circuit 38 is connected. Further, between the collector of a transistor T24 and the ground line 32, an NPN transistor T36 is connected. The base of the transistor T36 is connected to the emitter of the transistor T35.

Between the output node n21 of the differential amplifier 36 and the transistor T35, there is a transistor T34. To compensate an offset current caused by the base current of the transistor T34, a transistor T33 of which connection is the same as that of the transistor T34 is connected at the input side of the differential amplifier 36.

The collector of the transistor T36 acts as the output node n22 of the operational amplifier 27. Between the output node n22 and the output node n21 of the differential amplifier 36, a phase compensation capacitor C24 is connected.

Next, in the driving circuit 28, at the input of the driving circuit 28, an NPN transistor T37 is provided. The base and emitter of the transistor T37 are connected to the ground line 32 through resistors R28 and R29, respectively. Moreover, the base and collector of the transistor T37 are connected to the output node n22 through diodes D25 and D26, respectively, wherein both anodes of the diodes D25 and D26 are connected to the output node n22.

At the output of the driving circuit 28, an NPN transistor T38 is provided. The base and emitter of the transistor T38 are connected to the ground line 32 through a resistor R30 and a series circuit that includes resistors R31 and R32. The collector of the transistor T38 is connected to the base of the transistor T21 through the terminal 25*d* of the power supply control IC 25. The junction point of the resistors R31 and R32 is connected to the other end of the phase compensation capacitor C23 through a terminal 25*e* of the power supply control IC 25.

Between the regulated voltage line 31 and the collector of the transistor T37 and the base of the transistor T38, a current mirror circuit 39 including PNP transistors T39 and T40 is provided. The common base line 40 of the transistors T39 and T40 is connected to the regulated voltage line 31 through a resistor R33 and to the other end of the capacitor C22 through a resistor R34 and a terminal 25f of the power supply control IC 25. The current mirror circuit 39 acts as a driving circuit control circuit, and the series circuit 41 including the capacitor C22 and the resistor R34 for differentiation acts as a voltage detection circuit.

A steady state operation of the dc power supply will be described. In this state, the dc power supply 21 operates as general series type of dc power supply. The differential amplifier 36 as the operational amplifier 27 is supplied with the detected output voltage Vd detected by the voltage divider 26 and the reference voltage Vr (1 V) that is determined on the basis of the dividing ratio (5:1) and the target value of the output voltage Vo (5 V).

If the output voltage Vo decreases from the target voltage, the detected output voltage Vd also decreases below the reference voltage Vr. This increases the current flowing through the transistor T27 in the differential pair 34 and decreases the current flowing through the transistor T28. This decreases the voltage at the output node n21. The voltage of the output node n21 decreases the base voltage and collector voltage of the transistor T35 through the transistor T34. As a result, the voltage between base and emitter of the transistor T36 decreases, so that the voltage (amplified error voltage Ve) at the output node n22 increases.

In this state, the diodes D21 and D22 forming the clamp circuit 37 are in the off states, and the diodes D23 and D24 forming the clamp circuit 38 are on conditions. The clamp circuit 38 limits the collector voltage of the transistor T23 equal to or lower than 2·VF (VF is a forward voltage drop of diodes). This prevents the transistor T23 from going to a saturated ON condition.

When the amplified error voltage Ve of the operational amplifier increases, the base voltage (and the emitter voltage) of the transistor T37 increases at the driving circuit 28, so that the collector current of the transistor 37 increases. The collector current of the transistor T37 generates the current flow through the resistor R30 by the current mirror circuit 39. This increases the base voltage of the transistor T38, so that the collector current of the transistor T38, that is, the base current to the transistor T21 increases. As a result, the voltage drop between the emitter and collector of the transistor T21 decreases. This increases the output voltage Vo.

On the other hand, if the output voltage Vo increases above the target voltage, the operation relation in voltage at respective points is inverted. More specifically, the voltage at the output node n21 of the differential amplifier 36 increases, and the amplified error voltage Ve of the operational amplifier 27 decreases. This decreases the base current of the transistor T21. Accordingly, the voltage drop between the emitter and the collector of the transistor T21 increases. This decreases the output voltage Vo.

In the above-mentioned steady state (not a startup condition), the output voltage Vo is substantially equal to the target voltage, so the voltage variation is extremely low. Therefore, there is almost no current in the series circuit 41 including the capacitor C22 and the resistor R34. Hence the current mirror circuit 39 is subjected to no affection by the output voltage Vo. That is, the current mirror circuit 39 acts as only the current mirror operation in response to the amplified error voltage Ve.

In operation at startup condition will be described. When the battery voltage Vb is applied to the dc power supply 21 stepwise by turning the ignition switch, the constant voltage supply circuit 29 and the constant current supply circuit 30 immediately start their operations, so the operational amplifier 27 and the driving circuit 28 becomes operation conditions. On the other hand, the reference voltage Vr is always supplied to the differential amplifier 36 irrespective of the condition of the ignition switch.

At start of applying the battery voltage Vb, the output voltage Vo is 0 V for example. After this, the condition that the detected output voltage Vd is lower than the reference voltage Vr continues until the output voltage Vo reaches the target voltage. Therefore, during this interval the amplified error voltage Ve increases. Here, the transistor T36 is in an off condition because the difference between the detected output voltage Vd and the reference voltage Vr at the startup is large.

When the amplified error voltage Ve increases, the collector current of the transistor T37 increases as mentioned above. This collector current corresponds the collector current of the transistor T38 because of the current mirror circuit 39, that is, the base current of the transistor T21. Therefore, the voltage drop between the emitter and collector of the transistor T21 decreases, so the output voltage Vo starts increasing.

During the interval for which the output voltage Vo increases, a current corresponding the voltage variation of the output voltage Vo flows into the common base line 40 through the series circuit 41 including the capacitor C22 and the resistor R34. That is, a part of the collector current of the transistor T37 flows through the circuit other than the transistor T39. This part decreases the collector current of the transistor T39 and the collector current to the transistor T40 in accordance with its intensity.

During this operation, the collector current of the transistor T38, that is, the base current of the transistor T21, is lowered below that originally corresponding to the amplified error voltage Ve. Then, the voltage drop between the emitter and collector of the transistor T21 increases in accordance with the difference. As a result, the output voltage Vo increases at a constant rate of rise (through rate) with overriding the amplified error voltage Ve.

This rate is determined by the time constant mainly determined by the capacitance of the capacitor C22 and the resistance of the resistor R34. This time constant is set to enable the operational amplifier 27 to trace the variation of the output voltage Vo. Here, the resistor R34 can be omitted. In this case, the capacitance of the capacitor C22 and the resistance in the current mirror circuit 39 and the resistance in the circuit around the current mirror circuit 39 determine the time constant.

On the other hand, when the output voltage Vo increases above the target voltage, the voltage of the output node n21 of the differential amplifier 36 increases as mentioned above. If the clamp circuit 37 is not connected to the output node n21, the transistor T28 becomes a saturated ON condition with increase in the voltage difference. That is, the voltage Vn21 of the output node n21 increases up to the voltage represented by the following equation (1):

$$Vn21 = V_r + V_{BE}(T30) + V_{BE}(T28) - V_{CE}(T28) \quad (1)$$

herein $V_{BE}$ (T30) is a voltage between the base and emitter of the transistor T30, $V_{BE}$ (T28) is a voltage between the base and emitter of the transistor T28, and $V_{CE}$ (T28) is a saturation voltage between the collector and emitter of the transistor T28.

If the output voltage Vo decreases to the target voltage from this condition, the voltage Vn21 of the output node n21 should largely decrease to a value near 0 V from the value represented by the equation (1). This causes a delay in the voltage variation. That is, this causes the delayed operation in the operational amplifier 27. Accordingly, the output voltage Vo keeps decreasing after reaching the target voltage. This causes under shoot.

On the other hand, in this embodiment, the clamp circuit 37 is connected to the output node n21 to clamp the voltage Vn21 of the output node n21 to the 2·VF. This reduces the variation of the output node n21, so that the voltage variation of the output node n21 with the variation of the output voltage Vo is shortened. This improves the lag operations in the operational amplifiers 27, so the under shooting is eliminated.

Figure 2A:
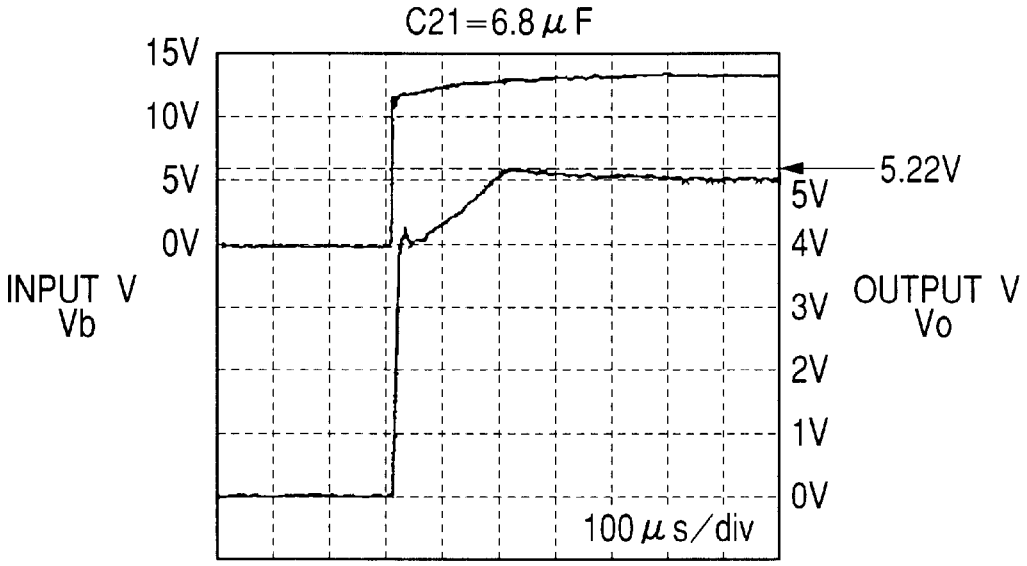
FIGS. 2A and 2B are graphical drawings showing waveforms of the battery voltage and the output voltage according to the first embodiment.
Figure 2B:
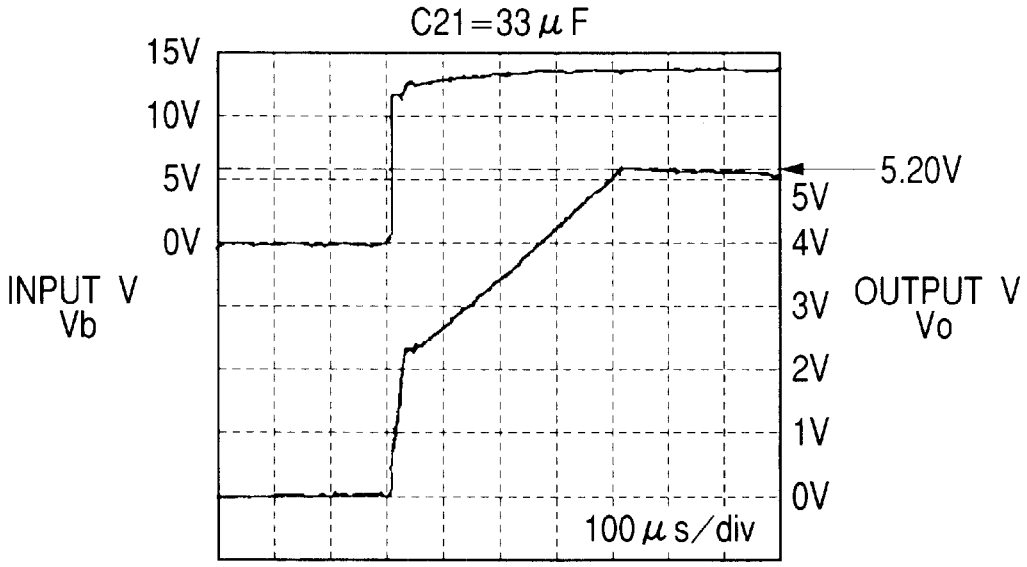

FIGS. 2A and 2B show waveforms of the battery voltage Vb and the output voltage Vo in which the capacitance of the capacitor C21 is varied at two values. That is, the capacitance of the capacitor C21 is set to 6.8 $\mu$F and 33 $\mu$F, and instead the engine control ECU, a resistive load of 12Ω is connected to the output terminal 23.

Figure 6:
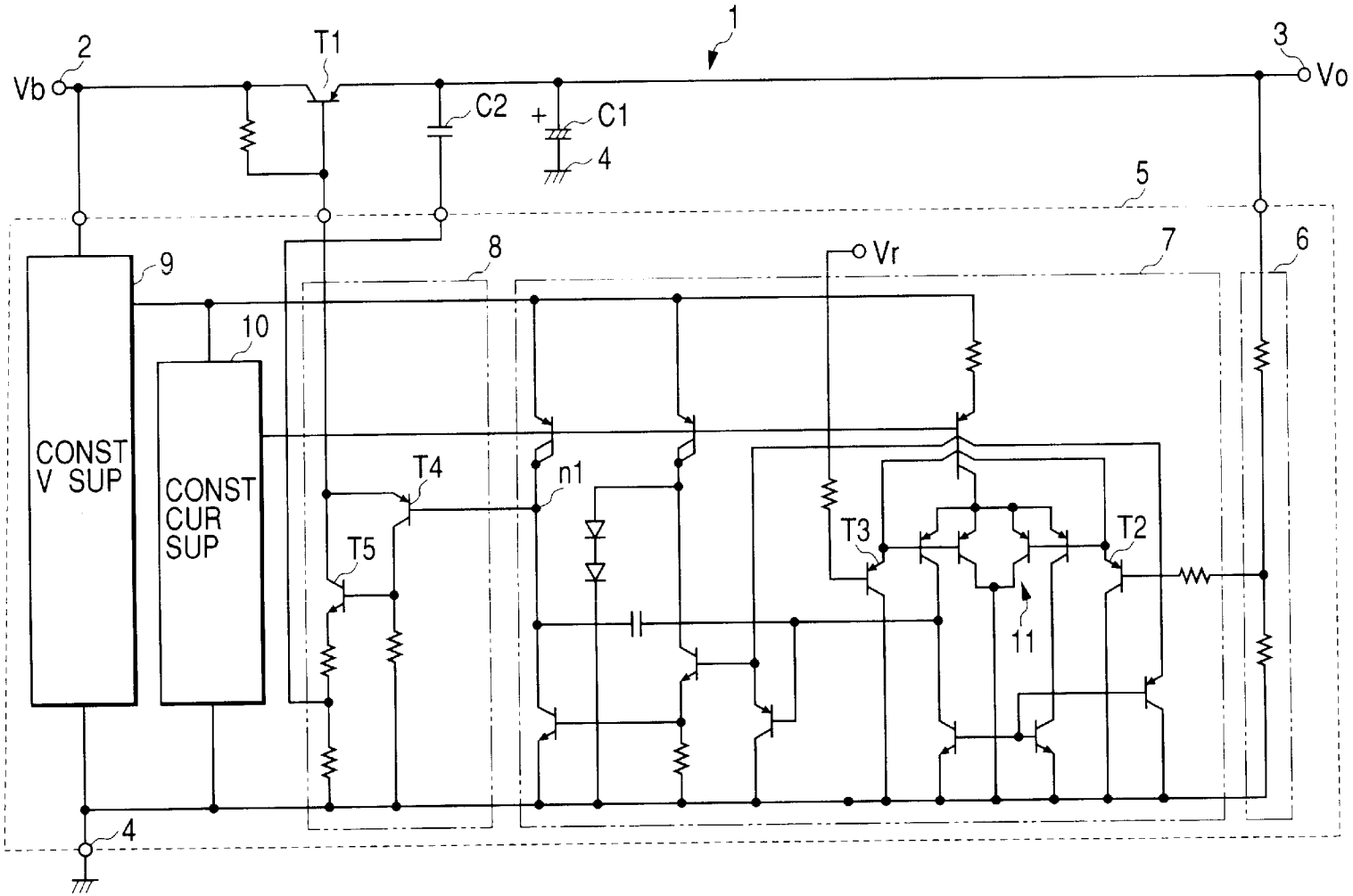
FIG. 6 PRIOR ART
FIG. 6 is a schematic circuit diagram of a prior art series regulator type of a dc power supply.
Figure 7A:
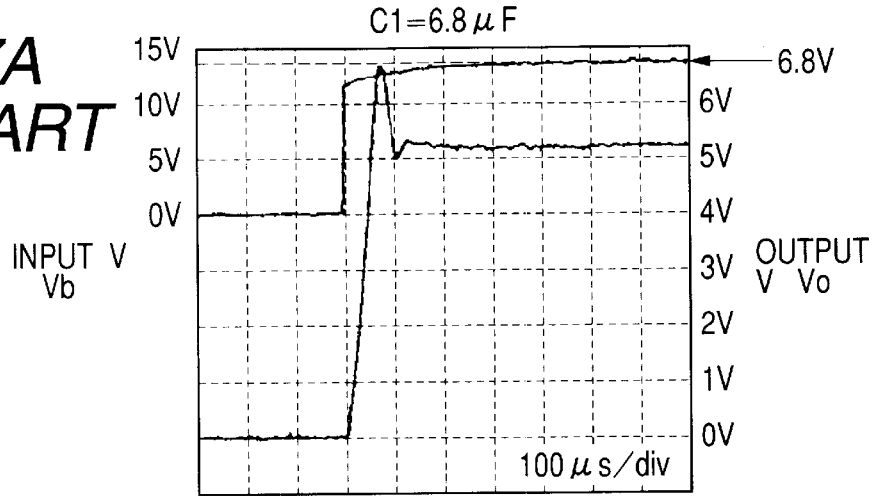
FIG. 7A PRIOR ART
FIGS. 7A to 7C are graphical drawings showing output voltage variations on startup of the dc power supply according to the prior art.
Figure 7B:
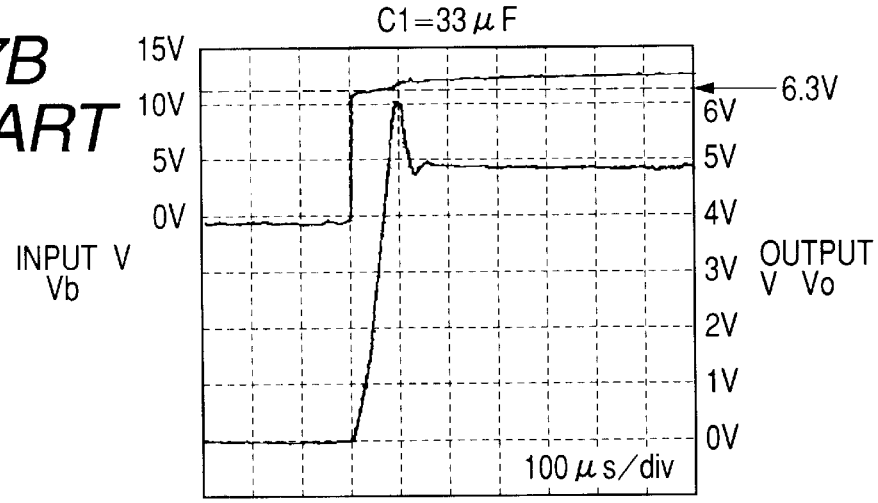
FIG. 7B PRIOR ART
Figure 7C:
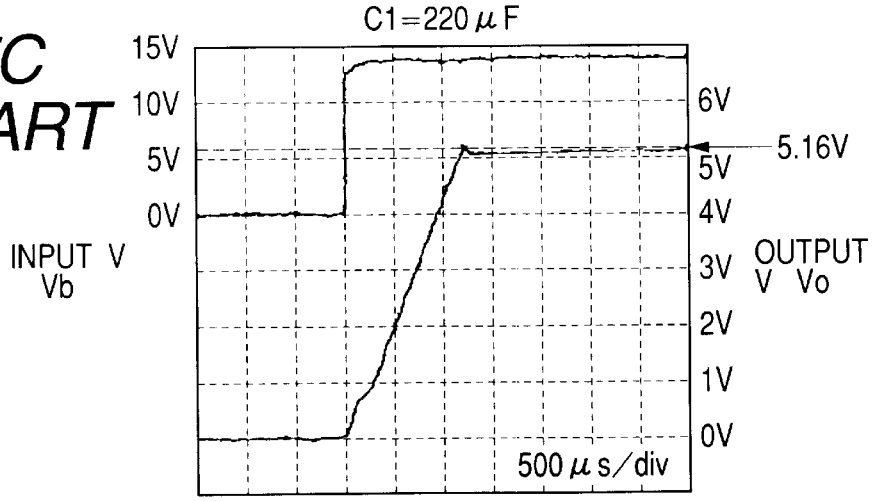
FIG. 7C PRIOR ART

In these conditions, when the battery voltage Vb is applied to the input terminal 22, the output voltage Vo rapidly rises up to intermediate voltages (4 V and 2.3 V) of the target voltage (5V). Next, the output voltage Vo gradually increases to the target voltage (5 V) at a substantially constant inclination (rate). Comparing these waveforms with the waveforms in FIGS. 7A to 7C observed in the prior art dc power supply shown in FIG. 6, overshoot is decreased from 1.8 V to 0.22 V if the capacitance of the capacitor C21 is 6.8 $\mu$F. If the capacitance of the capacitor C21 is 33 $\mu$F, overshoot is decreased from 1.3 V to 0.2 V. Moreover, in the waveforms in FIGS. 2A and 2B, no undershoot occurs.

In FIGS. 2A and 2B, the output voltage Vo rapidly rises because of the series circuit 41. More specifically, at start of applying the battery voltage Vb, the output voltage Vo is lower than the regulated voltage V1, so that a current charging the capacitor C22 temporarily flowing through the transistors T39 and T40 (between emitters and bases) and the resistor R34.

The interval for which this current flows is substantially determined by the time constant of the resistor R34 and the capacitor C22.

This charge current acts as the base currents of the transistors T39 and T40, so the collector currents increase. This increases the collector current of the transistor T38, that is, the base current of the transistor T21. As a result, the increasing rate of the output voltage Vo temporarily increases. The second embodiment improves this point. Therefore, this point will be further described at the second embodiment.

As mentioned above, the series regulator type of dc power supply 21 according to this embodiment includes the transistor T21 connected between the input and output terminals in series, the operational amplifier 27 for amplifying the error voltage between the detected output voltage Vd and the reference voltage Vr to output the amplified error voltage Ve, and the driving circuit 28 for driving the transistor T21 on the basis of the amplified error voltage Ve.

Moreover, the driving circuit 28 includes a current mirror circuit 39 between the transistor T37 for inputting the amplified error voltage Ve and transistor T38 for outputting the base current for the transistor T21, wherein the common base line 40 of the current mirror circuit 39 is connected to the output terminal through the series circuit 41 including the resistor R34 and the capacitor C22.

According to this structure, when the output voltage Vo rises, the current corresponding to the rising rate of the output voltage Vo flows through the collector of the transistor T37 through the series circuit 41 and the common base line 40. This reduces the current flowing through the current mirror circuit 39, that is, the base current of the transistor T21 on the startup.

Accordingly, at the startup of the dc power supply, the output voltage Vo rises at a relatively low rising rate (through rate) irrespective of the amplified error voltage Ve. This enables the operational amplifier 27 to trace the variation of the output voltage Vo. Therefore, though the battery voltage Vb is applied to this dc power supply stepwise, it is prevented to apply an excessive voltage o the load connected to the output terminal 23 with overshoot and undershoot suppressed.

This structure can suppress overshoot if the capacitance of the smoothing capacitor C21 is low. Therefore, the capacitance of the capacitor C21 can be reduced (for example, 6.8 $\mu$F). Such a small size enables this capacitor to be mounted on a printed circuit board as a surface mount device (SMD). Using the surface mount device reduces the cost of the part and also reduces the height and the area at the printed circuit board necessary for mounting the part. Moreover, this eliminates the necessity of providing through holes on the printed circuit board. Therefore, this structure can miniaturize and reduce the cost.

Moreover, the clamp circuit 37 is provided for the output node n21 of the differential amplifier 36. Therefore, though overshoot occurs, the clamp circuit 37 prevents saturation of the transistor T28 connected to the output node n21 and can limit the voltage variation width of the output node n21. This accelerates the voltage variation of the output node n21 against the variation in the output voltage Vo, so that under shoot can be prevented.

The series circuit 41 directly detects the variation in the output voltage at startup interval without delay (very shorter delay than the delay in the operational amplifier 27. The detected variation of the output voltage is supplied to the current mirror circuit 39. This suppresses the surge in the output voltage though the current mirror circuit 39 by controlling the drive current for the transistor T21. That is, the rise rate of the output voltage is controlled by the series circuit 41 for startup interval. The rise rate is determined such that the operational amplifier 27 can trace the variation of the output voltage, that is, the operational amplifier 27 amplifies the detected error voltage Vd within the controllable range.

That is, the amplifier amplifies the difference between the detected error voltage Vd and the reference voltage Vr within a controllable range in a steady condition of the dc power supply, and surge controlling suppresses a rate of the rise such that the operational amplifier 27 amplifies the difference within the controllable range of the operational amplifier 27 on said startup. This surge controlling by the series circuit 41 and current mirror circuit 39 effected until the output voltage reaches the target voltage.

SECOND EMBODIMENT

Figure 3:
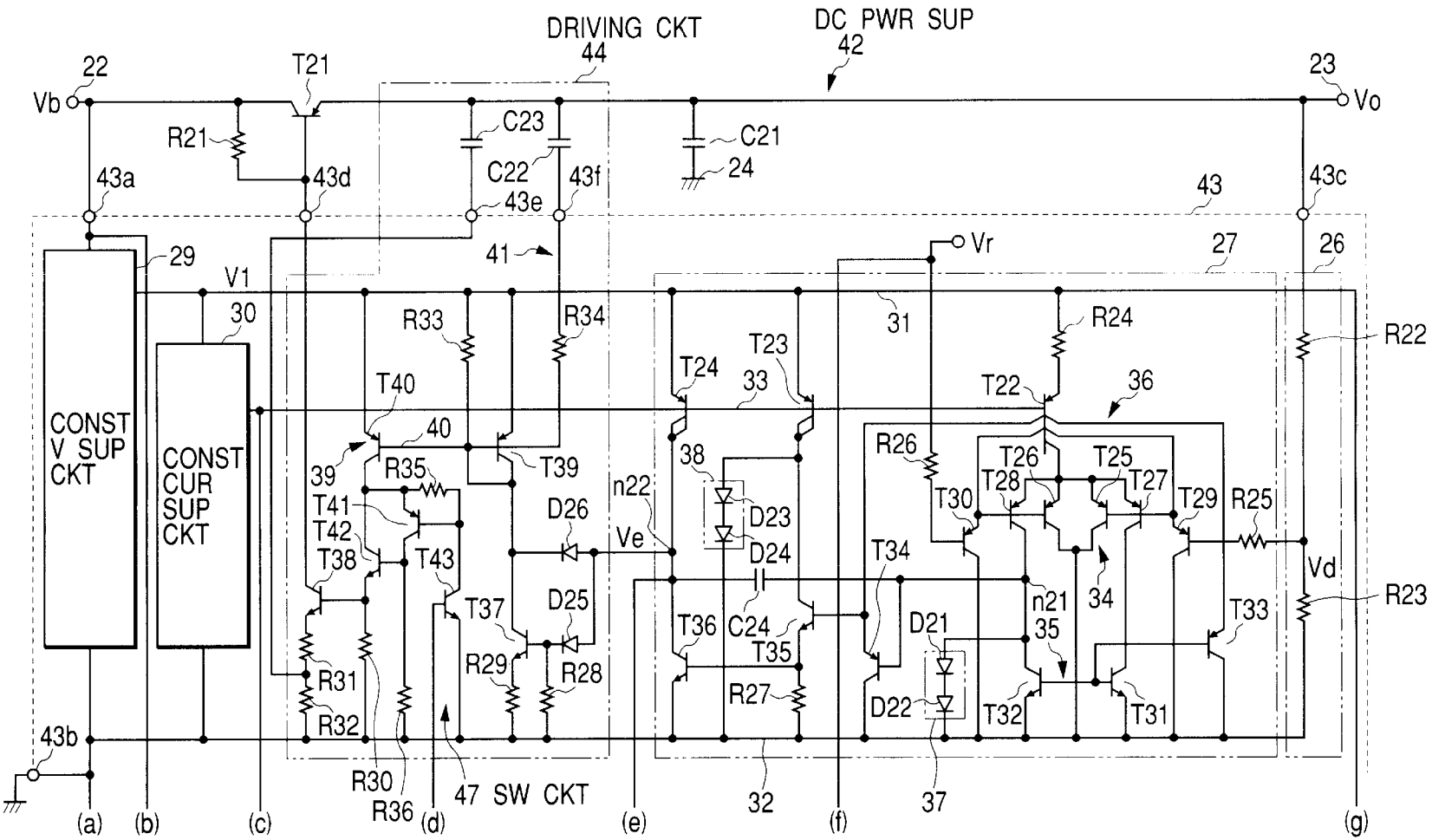
FIGS. 3 and 4 are schematic circuit diagrams of the dc power supply according to the second embodiment, wherein the partial circuit shown in FIG. 3 is connected to the another partial circuit shown in FIG. 4 through lines indicated by references (a) to (g)
Figure 4:
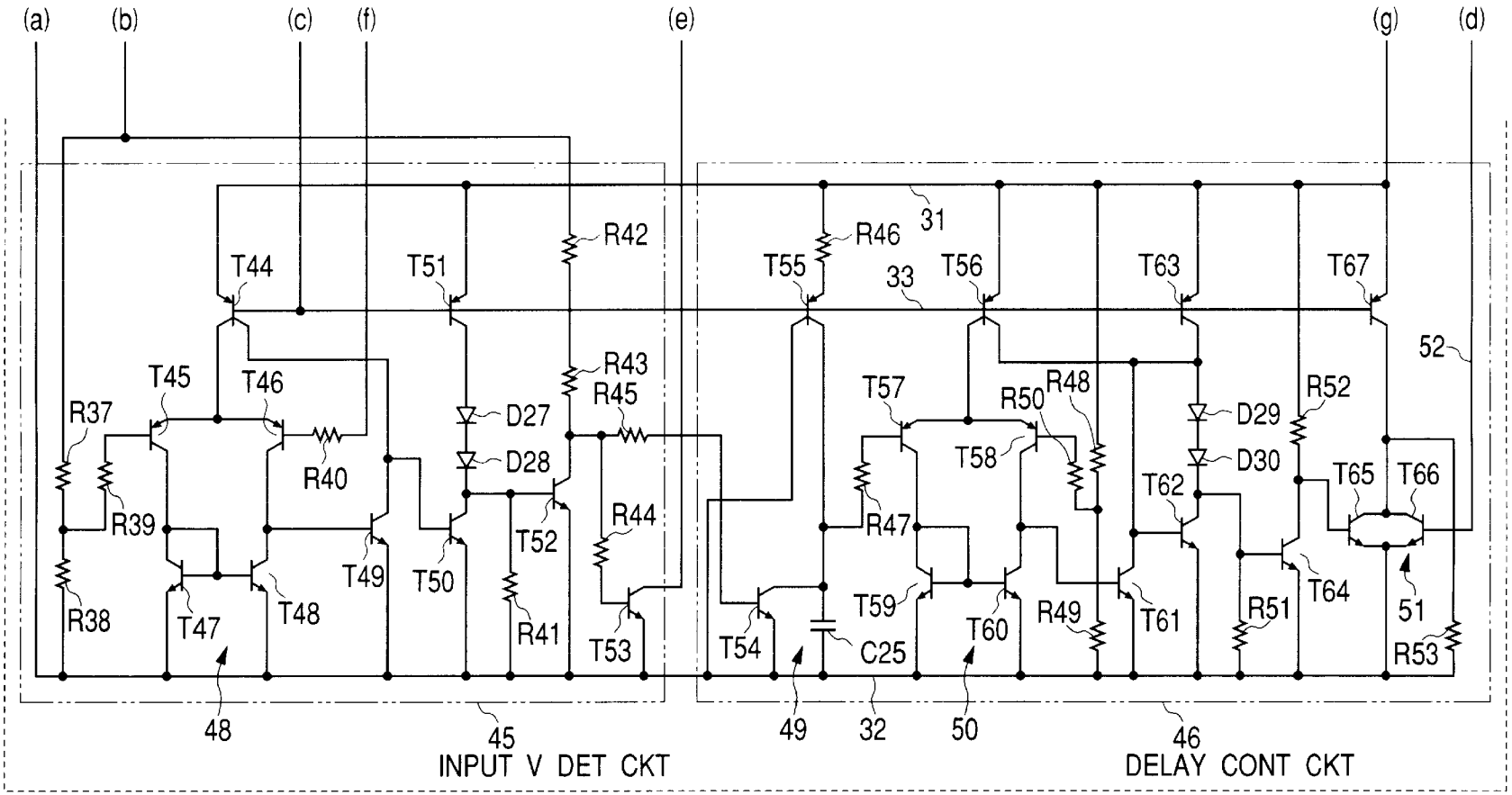

FIGS. 3 and 4 are schematic circuit diagrams of the dc power supply according to the second embodiment, wherein the circuit shown in FIG. 3 is connected to the circuit shown in FIG. 4 through lines indicated by references (a) to (g).

The dc power supply according to the second embodiment has the substantially the same structure as that of the first embodiment. The difference is that an input voltage detection circuit 45, a delay control circuit 46, and a switch circuit 47 are further provided.

In the driving circuit 44, the switch circuit 47 is connected between the collector of the transistor T40 and the base of the transistor T38. The switch circuit 47 includes transistors T41 and T42 that are connected by the Darlington connection, a transistor T43, a resistor R35, and a resistor R36. The transistor T43 is turn on and off in response to an output signal of the delay control circuit 46. When the transistor T43 is turned off, the transistors T41 and T42 are turned off, that is the switch circuit 47 is in an OFF condition. When the transistor T43 is turned on, the transistors T41 and T42 are turned on, that is, the switch circuit 47 is in an ON condition.

The input voltage detection circuit 45 has a structure of a comparator, and thus, when the input voltage (the battery voltage Vb) rises higher than predetermined voltage, the input voltage detection circuit 45 changes its output level from H to L, which is supplied to the delay control circuit 46 (transistor T54 mentioned later).

In the input voltage detection circuit 45, the transistors T44 to T48 form a differential amplifier 48. The battery voltage Vb is divided with a series circuit including resistors R37 and R38. The divided detection voltage is supplied to the base of a transistor T45 in the differential amplifier 48 through a resistor R39. Moreover, a reference voltage Vr is supplied to the base of the output transistor T46 of the differential amplifier 48 through a resistor R40.

The transistor T49 is connected to the differential amplifier 48 to output the output of the differential amplifier 48. The collector of the transistor T49 is connected to the base of a transistor T50. As the following stage of the differential amplifier 48, a two-stage circuit is connected to the differential amplifier 48. The transistor T50 is the first stage of this circuit.

The transistor T50 is driven with a constant current by the transistor connected to the common base line 33. The collector of the following stage of the transistor T52 is connected to the terminal 43*a*. Moreover, between the output node n22 of the operational amplifier 27 and the ground line 32, a transistor T53 is connected. The collector of the transistor T52 is connected to the base of the transistor T53 through a resistor R44.

The delay control circuit 46 charges and discharges a capacitor C25 in response to the output signal from the input voltage detection circuit 45 to generate a predetermined delay interval. That is, between both terminals of the capacitor C25, a transistor T54 is connected. The collector of the transistor 52 is connected to the base of the transistor T54 through a resistor R45.

Moreover, between the regulated voltage line 31 and the capacitor C25, a series circuit including a resistor R46 and a transistor T55 is connected, wherein the base of the transistor T55 is connected to the common base line 33. The capacitor C25, the transistors T54 and T55 and the resistor R46 form a charge-discharge circuit 49.

Transistors T56 to T60 form a differential circuit 50. The charging voltage of the capacitor C25 is supplied to the base of a transistor T57 at the input side of the differential amplifier 50. Between the regulated voltage line 31 and the ground line 32, a series circuit including resistors R48 and R49 is connected. The junction point between the resistors R48 and R49 is connected to the base of a transistor T58 at the output side of the differential circuit 50 through a resistor R50.

The transistor T61 is provided to output the output of the differential amplifier 50, and its collector is connected to the base of the transistor T62. After the differential amplifier 50, a multi-stage circuit is connected of which first stage corresponds to the transistor T62. The transistor T62 is driven with a constant current by a transistor T63 connected to the common base line 33.

After the transistor T62, a series circuit including a resistor R52 and a transistor T64 is connected between the regulated voltage line 31 and the ground line 32. Between the base and emitter of the transistor T64, a resistor R51 is connected. After this circuit, transistors T65 and T66 are provided, wherein their collectors and emitters are connected with each other, respectively. Between the regulated voltage line 31 and these collectors, a transistor T67 connected, the base of which is connected to the common base line 33. The transistor T66 and the transistor T43 in the driving circuit 44 form a current mirror circuit 51. A resistor R53 is connected between the common base line 52 and the ground line 32.

In operation of the dc power supply 42 will be described with FIG. 5. The dc power supply 42 suppresses the severe rise of the output voltage Vo when supplying the battery voltage is started.

In the input voltage detection circuit 45, the differential amplifier 48 compares the divided voltage of the battery voltage Vb with the reference voltage Vr. When the divided voltage becomes higher than the reference voltage Vr after start of supplying the battery voltage Vb, the transistor T49 turns on from an off condition, so that its collector potential becomes about 0 V. This turns off the transistor T50, turns on the transistor T52, and turns off the transistor T53.

An output signal from the input voltage detection circuit 45 controls the transistor T54. That is, until the divided voltage has reached the reference voltage Vr, the transistor T54 turns on, so that the capacitor C25 is discharged. When the divided voltage increases above the reference voltage Vr, the transistor T54 turns off, so that a constant current flows into the capacitor C25 from the regulated voltage line 31 through the resistor R46 and the transistor T55. As a result, the voltage between the both capacitor C25 gradually increases.

The differential amplifier 50 compares the charging voltage to this capacitor C25 with the divided voltage of the regulated voltage V1 from the resistors R48 and R49. If the charge voltage increases above the divided voltage of the regulated voltage V1, the transistor T61 turns on. This turns off the transistor T62, turn on the transistor T64, and turns off the transistor T65.

As a result, from when the battery voltage Vb has risen to when the delay interval determined by the charging interval of the capacitor C25 , no current flows through the transistors T66 and T43 forming the current mirror circuit 51, so that off conditions of the switch circuit 47 and the transistor T21 are kept. After the delay interval, the transistors T66 and T43 begin to flow a current. This turns on the switch circuit 47 and the transistor T21.

As described in the first embodiment, in the driving circuit 44, on startup of applying the battery voltage Vb, base currents temporarily flow through the transistors T39 and T40 due to the charge current to the capacitor C22. On the other hand, in this embodiment, the delay interval is made longer than the interval of charging current to the capacitor C22. Therefore, after the battery voltage Vb has risen, the transistor T21 is kept off until the base current flowing through the transistors T39 and T40 sufficiently decreases. This prevents the rapid rise of the output voltage Vo.

Figure 5:
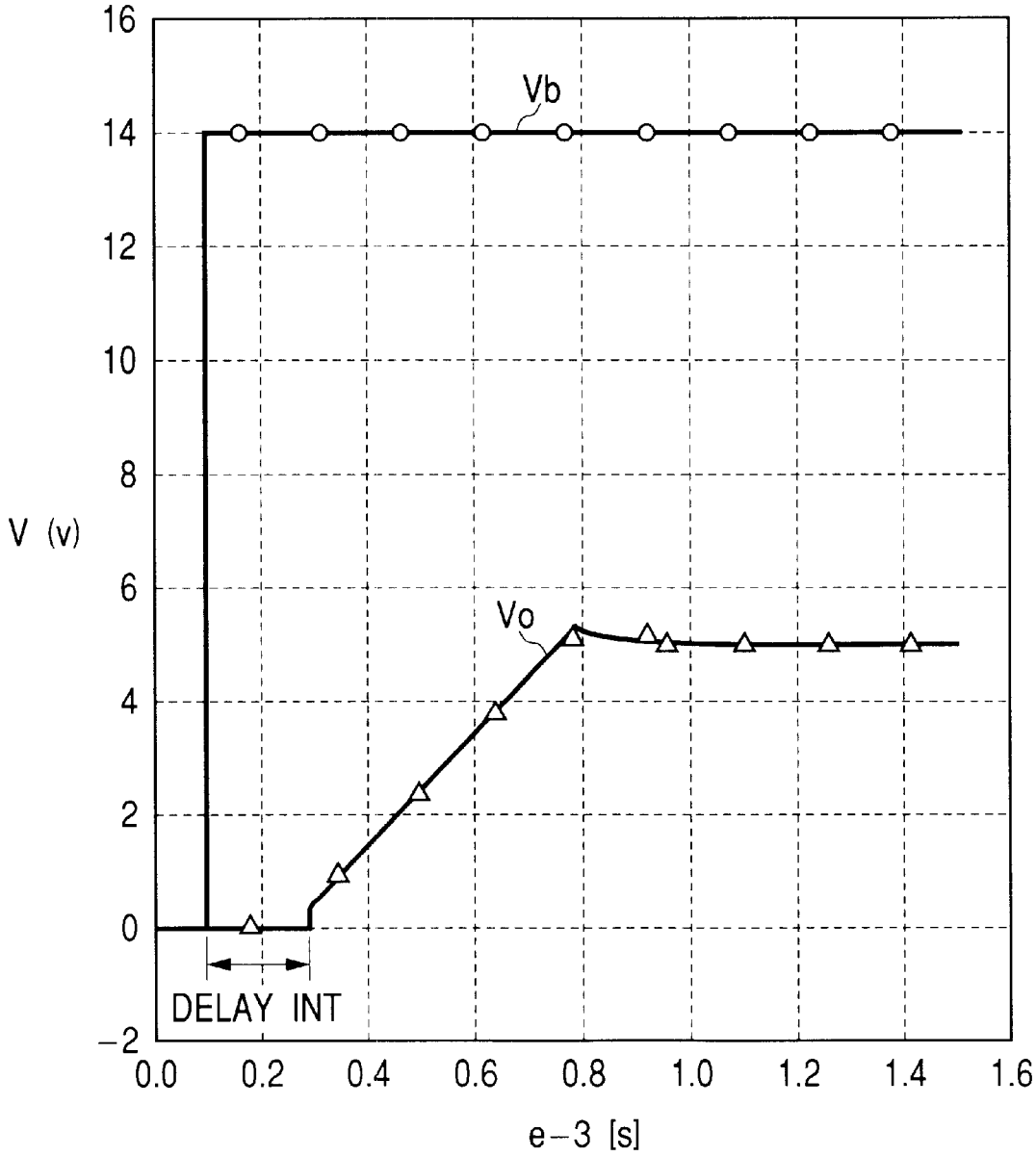
FIG. 5 is a graphical drawing showing a simulation waveform of the output voltage Vo of the dc power supply at the startup condition according to a second embodiment.

FIG. 5 shows a simulation waveform of the output voltage Vo of the dc power supply 42 at the startup condition. In FIG. 5, at timing 0.1 ms, supplying the battery voltage Vb is started. On the other hand, the output voltage Vo starts to rise from the timing of 0.3 ms at a relative moderate rate of rising (through rate). The interval of 0.2 ms from the timing of 0.1 ms to the timing of 0.3 ms corresponds to the above-mentioned delay interval. For this interval the transistor T21 is kept off. Therefore, in FIG. 5, there is no rapid rise in the output voltage Vo. Therefore, though the operational amplifier 27 has a low gain (which is determined by the resistors R22 and R23), overshoot and undershoot can be prevented.

As mentioned above, the dc power supply 42 according to the second embodiment further includes the switch circuit 47 at the output portion of the current mirror circuit 39 in the driving circuit 44, the input voltage detection circuit 45, and the delay control circuit 46 as the delay circuit to keep the transistor T21 off from the start of supplying the battery voltage to the expiration of the predetermined delay time. This prevents the severe rise of the output voltage Vo through the charging current flows into the capacitor C22 at start of supplying the battery voltage. Therefore, overshoot and undershoot can be prevented irrespective of the voltage of the reference voltage Vr.

MODIFICATIONS

This invention provides modifications as follows:

The dc power supplies 21 and 42 are of series type regulator. However, this invention is applicable to a parallel type of regulator in which the transistor T21 is connected in parallel to the load.

Moreover, the transistor T21 connected between the input and the output is of bipolar. However, a MOSFET or an IGBT can be used as the transistor T21 instead the bipolar transistor.

Moreover, in the power supply control IC 25 or the IC 43, bipolar transistors are used in the operational amplifier 27, the driving circuit 28, the input voltage detection circuit 45, and the delay control circuit 46. However, MOSFETs can be used for them.

It is sufficient that the current mirror circuit 39 and the series circuit 41 operate to suppress the inclination of rise of the output voltage Vo at startup of the dc power supply. Accordingly, for example, in the steady condition, the series circuit 41 can be electrically disconnected.

The structure of the voltage detection circuit 41 is not limited to the structure shown in FIG. 1. That is, the circuit only capable of detecting the variation of the output voltage Vo can be used. Moreover, the driving control circuit is not limited to the current mirror circuit 39. That is, the circuit only capable of changing the base current of the transistor T21 in accordance with the detected output voltage Vo can be used.

In the second embodiment, it is favorable that the input voltage detection circuit 45 is formed with a comparator with hysteresis. Moreover, the delay control circuit 46 can develop the delay interval in other method than charging the capacitor.

In the first and second embodiments, between the output terminal 23 and the current mirror circuit 39, the series circuit 41 including the capacitor C22 and the resistor R34 is connected. However, the resistor R34 can be omitted. In this case, the capacitance of the capacitor C22 and the resistance in the current mirror circuit 39 and the resistance in the circuit around the current mirror circuit 39 determine the time constant, so only the capacitance of the capacitor C22 is determined to control the rise of the output voltage at the startup without an additional resistor.

What is claimed is:

1. A dc power supply comprising:

a transistor for converting an input voltage into an output voltage on the basis of a driving condition;

an error amplifier for generating an error signal on the basis of a difference voltage between a reference voltage and said output voltage; and a driving circuit for driving said transistor on the basis of said error signal, for directly detecting said output voltage, and for controlling said driving condition to control a rise of said output voltage on the basis of said directly detected output voltage on at least a startup of said dc power supply.

2. A dc power supply as claimed in claim 1, wherein said driving circuit suppresses a rate of said rise until said amplified error signal becomes in a steady condition after said startup.

3. A dc power supply as claimed in claim 1, wherein said driving circuit suppresses a rate of said rise such that said amplified error signal can trace said output voltage.

4. A dc power supply as claimed in claim 1, wherein said driving circuit includes:

voltage detection circuit for detecting a variation of said output voltage; and a driving control circuit for controlling said driving condition of said transistor on the basis of said variation detected by said voltage detection circuit.

5. A dc power supply as claimed in claim 1, wherein said driving circuit drives said transistor in accordance with a drive current having a magnitude determined in accordance with a magnitude of said error signal in a steady condition.

6. A dc power supply as claimed in claim 5, wherein said driving circuit suppresses a rate of said rise until said amplified error signal enters a steady condition after said startup.

7. A dc power supply as claimed in claim 5, wherein said driving circuit suppresses a rate of said rise for permitting said amplified error signal to trace said output voltage.

8. A dc power supply comprising:

a transistor for converting an input voltage into an output voltage on the basis of a driving condition;

an error amplifier for generating an error signal on the basis of a difference voltage between a reference voltage and said output voltage; and a driving circuit for driving said transistor on the basis of said error signal, for directly detecting said output voltage, and for controlling said driving condition to control a rise of said output voltage on at least a startup of said dc power supply, wherein said driving circuit includes:

a voltage detection circuit for detecting a variation of said output voltage ; and a driving control circuit for controlling said driving condition of said transistor on the basis of said variation detected by said voltage detection circuit, wherein said driving control circuit comprises a current mirror circuit for outputting a current determining said driving condition of said transistor in response to a current corresponding to said error signal, and said voltage detection circuit comprises a capacitor and a resistor connect ed in series, connected between said output voltage and a common control input of said current mirror circuit.

9. A dc power supply as claimed in claim 8, further comprising a delay circuit for keeping said transistor in an OFF condition for a predetermined delay interval after start of supplying said input voltage to said dc power supply.

10. A dc power supply as claimed in claim 9, wherein said driving circuit further comprises a switch circuit for cutting off an output current of said current mirror circuit, and said delay circuit comprise an input voltage detection circuit for detecting start of supplying of said input voltage and a delay control circuit for controlling said switch circuit in said cutoff condition for said delay time from said start of supplying of said input voltage.

11. A dc power supply as claimed in claim 8, wherein said driving circuit suppresses a rate of said rise until said amplified error signal enters a steady condition after said startup.

12. A dc power supply as claimed in claim 8, wherein said driving circuit suppresses a rate of said rise for permitting said amplified error signal to trace said output voltage. rise of said rise for permitting said amplified error signal to trace said output voltage.

13. A dc power supply comprising:

a transistor for converting an input voltage into an output voltage on the basis of a driving condition;

an error amplifier for generating an error signal on the basis of a difference voltage between a reference voltage and said output voltage, wherein said error amplifier comprises a clamp circuit for accelerating a response of said error amplifier; and a driving circuit for driving said transistor on the basis of said error signal, for directly detecting said output voltage, and for controlling said driving condition to control a rise of said output voltage on at least a startup of said dc power supply.

14. A dc power supply as claimed in claim 13, wherein said error amplifier comprises a differential amplifier and said clamp circuit includes a diode connected to an output of said differential amplifier.

15. A dc power supply as claimed in claim 13, wherein said driving circuit suppresses a rate of said rise until said amplified error signal enters a steady condition after said startup.

16. A dc power supply as claimed in claim 13, wherein said driving circuit suppresses a rate of said rise for permitting said amplified error signal to trace said output voltage.

17. A dc power supply as claimed in claim 13, wherein said driving circuit includes:

a voltage detection circuit for detecting a variation of said output voltage; and a driving control circuit for controlling said driving condition of said transistor on the basis of said variation detected by said voltage detection circuit.

18. A dc power supply as claimed in claim 17, wherein said driving control circuit comprises a current mirror circuit for outputting a current determining said driving condition of said transistor in response to a current corresponding to said error signal, and said voltage detection circuit comprises a capacitor and a resistor connected in series and connected between said output voltage and a common control input of said current mirror circuit.

19. A dc power supply as claimed in claim 18, further comprising a delay circuit for keeping said transistor in an OFF condition for a predetermined delay interval after start of supplying said input voltage to said dc power supply.

20. A dc power supply as claimed in claim 19, wherein said driving circuit further comprises a switching circuit for switching off an output current of said current mirror circuit, and said delay circuit comprise an input voltage detection circuit for detecting a start of supplying said input voltage and a delay control circuit for controlling said switching circuit in said cutoff condition for said delay time from said start of supplying of said input voltage.

21. A dc power supply comprising:

a transistor for converting an input voltage into an output voltage on the basis of a driving condition;

an error amplifier for generating an error signal on the basis of a difference voltage between a reference voltage and said output voltage; and a driving circuit for driving said transistor on the basis of said error signal, directly detecting said output voltage, and controlling said driving condition to control a rise of said output voltage on at least a startup of said dc power supply, wherein said driving circuit includes:

a voltage detection circuit for detecting a variation of said output voltage, wherein said voltage detection circuit includes only a capacitor; and a driving control circuit for controlling said driving condition of said transistor on the basis of said variation detected by said voltage detection circuit.

22. A dc power supply as claimed in claim 21, wherein said driving circuit suppresses a rate of said rise until said amplified error signal enters a steady condition after said startup.

23. A dc power supply as claimed in claim 21, wherein said driving circuit suppresses a rate of said rise for permitting said amplified error signal to trace said output voltage.

24. A dc power supply comprising:

a transistor for converting an input voltage into an output voltage on the basis of a driving signal;

an error voltage detection circuit including an amplifier for generating an amplified error signal in accordance with a difference between a reference voltage and said output voltage with a predetermined delay to control said output voltage toward a target voltage;

a driving circuit for generating said drive signal on the basis of said amplified error signal; and a surge control circuit including a detection circuit for directly detecting said output voltage change with substantially no delay and a control circuit for controlling said driving circuit to control a rise of said output voltage on a startup of said dc power supply on the basis of said detected output voltage change.

25. A dc power supply as claimed in claim 24, wherein said surge control circuit suppresses a rate of said rise until said output voltage reaches said target voltage on said startup.

26. A dc power supply as claimed in claim 24, wherein said amplifier amplifies said difference within a controllable range in a steady condition of said dc power supply, and surge control circuit suppresses a rate of said rise such that said amplifier amplifies said difference within said controllable range on said startup.

27. A dc power supply as claimed in claim 24, further comprising a delay circuit for keeping said transistor in an OFF condition for a predetermined delay interval after start of supplying said input voltage to said dc power supply.

28. A dc power supply as claimed in claim 24, wherein said amplifier comprises a signal transistor for amplifying said error signal and a clamp circuit for clamping an output of said signal transistor to accelerate a response of said amplifier.

29. A dc power supply as claimed in claim 24, wherein said detection circuit including resistive means and a capacitor, and said control circuit include a resistance to said capacitor as said resistive means.

* * * * *